US011821178B2

(12) United States Patent
Wilson

(10) Patent No.: US 11,821,178 B2
(45) Date of Patent: Nov. 21, 2023

(54) EDGE WEAR PROTECTOR SYSTEM

(71) Applicant: MAKURI TECHNOLOGY PTE. LTD., Singapore (SG)

(72) Inventor: Ian James Wilson, Bali (ID)

(73) Assignee: Makuri Technology Pte. Ltd., Singapore (SG)

( * ) Notice: Subject to any disclaimer, the term of this patent is extended or adjusted under 35 U.S.C. 154(b) by 643 days.

(21) Appl. No.: 16/978,753

(22) PCT Filed: Mar. 9, 2018

(86) PCT No.: PCT/SG2018/050108
§ 371 (c)(1),
(2) Date: Sep. 7, 2020

(87) PCT Pub. No.: WO2019/172838
PCT Pub. Date: Sep. 12, 2019

(65) Prior Publication Data

US 2020/0399870 A1 Dec. 24, 2020

(51) Int. Cl.
*E02F 9/28* (2006.01)

(52) U.S. Cl.
CPC ..... *E02F 9/2883* (2013.01); *E02F 9/2816* (2013.01)

(58) Field of Classification Search
CPC ..... E02F 9/285; E02F 9/2858; E02F 9/2808; E02F 9/2816; E02F 9/2883
See application file for complete search history.

(56) References Cited

U.S. PATENT DOCUMENTS 711,992 A * 10/1902 Mason ..... E02F 9/2808 37/450
3,281,972 A * 11/1966 Kerestes ..... E02F 9/2808 172/698
3,431,664 A * 3/1969 Creager ..... E02F 9/2808 37/453
3,736,664 A 6/1973 Black
4,269,274 A * 5/1981 Robertson ..... A01B 15/025 172/699
4,428,131 A 1/1984 Hahn
(Continued)

OTHER PUBLICATIONS

International Preliminary Report on Patentability dated Nov. 7, 2019 for PCT Application No. PCT/SG2018/050108 in English.
(Continued)

*Primary Examiner* — Adam J Behrens
(74) *Attorney, Agent, or Firm* — Martin & Ferraro, LLP

(57) ABSTRACT

An edge wear protector system adapted to be attached to a plate of a bucket is provided. Edge wear protector system includes a first side member having a proximal end and a distal end opposite the proximal end, the first side member adapted to be attached to one side of the plate, a second side member having a near end and a far end opposite the near end, the second side member adapted to be attached to another side of the plate, the another side of the plate being opposite the one side of the plate, an end member adapted to be attached to an edge of the plate, the edge of the plate extends from the one side to the another side of the plate, such that the first side member is attachable to the end member via its proximal end and the second side member is attachable to the end member via the near end.

20 Claims, 8 Drawing Sheets

(56) References Cited

U.S. PATENT DOCUMENTS

| | | | | |
|---|---|---|---|---|
| 4,716,667 | A * | 1/1988 | Martin | E02F 9/2816 37/456 |
| 5,172,501 | A * | 12/1992 | Pippins | E02F 9/2825 37/453 |
| 5,713,145 | A | 2/1998 | Ruvang | |
| 2002/0078607 | A1* | 6/2002 | Perry | E02F 9/2883 37/446 |
| 2007/0148487 | A1 | 6/2007 | Kramer | |
| 2010/0275473 | A1 | 11/2010 | Maher | |
| 2014/0215867 | A1 | 8/2014 | Amada | |
| 2014/0319257 | A1* | 10/2014 | Clemons | E02F 3/965 241/266 |
| 2014/0331480 | A1* | 11/2014 | Warner | E02F 9/2891 37/456 |
| 2016/0153178 | A1* | 6/2016 | Amstutz | E02F 9/285 37/453 |
| 2017/0058491 | A1 | 3/2017 | Kunz | |
| 2017/0089034 | A1 | 3/2017 | Falkenhagen | |
| 2023/0062218 | A1* | 3/2023 | Serrurier | E02F 9/2858 |

OTHER PUBLICATIONS

International Search Report dated May 17, 2018 for PCT Application No. PCT/SG2018/050108 in English.

* cited by examiner

EDGE WEAR PROTECTOR SYSTEM

The present application is a US national phase application under 35 U.S.C. § 371 of International Application No. PCT/SG2018/050108, filed Mar. 9, 2018 (published as WO 2019/172838 on Sep. 12, 2019); all of which is incorporated by reference herein in its entirety.

TECHNICAL FIELD

The present invention relates to an edge wear protector system adapted to be attached to a plate of a bucket suitable for earth moving equipment. For example, a wear protector system adapted to be attached to the leading edges of structural steel plates as designed and manufactured to make buckets suitable for earth moving equipment.

BACKGROUND

Construction, quarry, and mining machines, such as shovels, excavators, loaders, stacker/reclaimers and draglines, of all types and configurations, make use of buckets of all types and configurations to dig, move and load materials. The maintenance and replacement costs for the buckets and the machines in general form a large part of the overall cost and profitability of the operation. Therefore, having a large degree of operating time, with the least amount of unplanned maintenance combined with low operating and capital replacement costs are all critical requirements for a successful operation.

Buckets can be subjected to extreme wear from the abrasion and impacts experienced during the digging, moving and loading of materials. Therefore, the bucket leading edge lips and side cheek plates are protected against impacts and abrasive wear by use of wear protector systems variously called Wear Edges, Wing, Cheek or Lip Shrouds. These are typically one piece cast designs that wrap around and protect the front lower lip and both front side walls that are exposed to the abrasion and impact from digging. Once worn out, or have fallen off, the protector systems are removed and/or replaced.

The size and weight of the wear protectors affect the lifespan of the wear protectors. Understandably, the larger the wear protector, the more material there is to wear out and hence the longer its lifespan. However, the larger the wear protector, the heavier the bucket and the higher digging resistance created by the higher profile too. Typically, the wear protector is manufactured in low cost abrasion resistant cast steels and as a result, the wear protector wears out faster due to both its low hardness and larger profile. As such, more frequent replacements are required and all associated removal, replacements costs and downtime increase the operation costs.

Furthermore, as bucket leading edge lips and cheeks have different profiles, many variations of wear protectors are required to accommodate these edges. Referring to FIG. 1, a bucket 10 has plates of different edges profiles. For example, the front side walls or cheek plates 12 may have a square profile. Base plate or lips 14 may have tapered edge profile. Therefore, it is very difficult to create one type of wear protector to fit all styles. One way of overcoming this variation is to provide a larger than necessary wear protector so as to provide a large clearance at the corner joint area to accommodate the different types of joints. As mentioned, the larger wear protector results in a heavier bucket 10 and higher digging resistance.

Wear protectors are typically pinned on with some form of locking pins or bolting system or welded on to the buckets. Poorly fitted wear protectors may cause fretting wear on the mounting surfaces of the buckets which would require rebuilding before new wear protectors can be refitted.

Existing designs of wear protectors often fall off before they are worn out due to structural mounting issues and the downstream damages caused in conveying and crushing systems can be significant.

It is therefore an objective of the present invention to overcome the above disadvantages. Particularly, compared to conventional systems, the present invention should be designed to be able to achieve their full life and have a relatively longer lifespan, to add less amount of weight to the bucket, to have a lower profile and associated digging friction, to be able to fit all bucket shapes. In addition, it is advantageous that the present invention be able to be secured to the bucket during operation without falling off the bucket prematurely and yet still be easy to fit and remove.

SUMMARY

According to various embodiments, an edge wear protector system adapted to be attached to a plate of a bucket is provided. Edge wear protector system includes a first side member having a proximal end and a distal end opposite the proximal end, the first side member adapted to be attached to one side of the plate, a second side member having a near end and a far end opposite the near end, the second side member adapted to be attached to another side of the plate, the another side of the plate being opposite the one side of the plate, an end member adapted to be attached to an edge of the plate, the edge of the plate extends from the one side to the another side of the plate, such that the first side member is attachable to the end member via its proximal end and the second side member is attachable to the end member via the near end.

According to various embodiments, the end member may include an access hole extending through the end member, such that the access hole may be adapted to be connected to at least one of the first side member and the second side member.

According to various embodiments, the end member may include a front side and a rear side behind the front side, such that the first side member may be attachable to the rear side of the end member via its proximal end and the second side member may be attachable to the rear side of the end member via the near end.

According to various embodiments, the end member may include a protruding front side.

According to various embodiments, the front side may include an outwardly protruding wedge.

According to various embodiments, the end member may include an upper layer and a lower layer adapted to be connected to the plate, such that the upper layer may be made from a material harder than that of the lower layer.

According to various embodiments, the first side member may include an access hole extending through the first side member.

According to various embodiments, the first side member may include an attaching side adapted to contact the plate when the first plate may be attached to the plate, the attaching side may include a plug duct adapted to receive a plug weld therein.

According to various embodiments, the first side member may include a connecting side adapted to contact the end member, such that the plug duct may be disposed along an intersection between the attaching side and the connecting side of the first side member.

According to various embodiments, the first side member may include an outer layer and an inner layer adapted to be connected to the plate, such that the outer layer may be made from a material harder than that of the inner layer.

According to various embodiments, second side member may include an access hole extending through the second side member.

According to various embodiments, the second side member may include an attaching side adapted to contact the plate when the first plate may be attached to the plate, the attaching side may include a plug duct adapted to receive a plug weld therein.

According to various embodiments, the second side member may include a connecting side adapted to contact the end member, such that the plug duct may be disposed along an intersection between the attaching side and the connecting side of the second side member.

According to various embodiments, the first side member may include an outer layer and an inner layer adapted to be connected to the plate, such that the outer layer may be made from a material harder than that of the inner layer.

According to various embodiments, the protector system may further include a filler member adapted to be attached to the plate, the filler member adapted support at least one of the first side member and the end member.

According to various embodiments, the filler member may be adapted to be connected to at least one of the first side member and the end member.

According to various embodiments, the filler member may include a through hole.

According to various embodiments, the filler member may include a first attaching surface adapted to contact the plate and a connecting surface adapted to face the end member, such that the filler member may include a first plug chamfer disposed along an intersection between the first attaching surface and the connecting surface, the first plug chamfer adapted to receive a plug weld.

According to various embodiments, the filler member may include a second attaching surface adapted to face the first side member and a connecting surface adapted to face the end member, such that the filler member may include a second plug chamfer disposed along an intersection between the second attaching surface and the connecting surface, the second plug chamfer adapted to receive a plug weld.

According to various embodiments, the end member may include an access hole extending through the end member, such that the access hole may be adapted to be connected to at least one of the first side member, the second plate and the filler member.

DETAILED DESCRIPTION

In the following examples, reference will be made to the figures, in which identical features are designated with like numerals.

Figure 1:
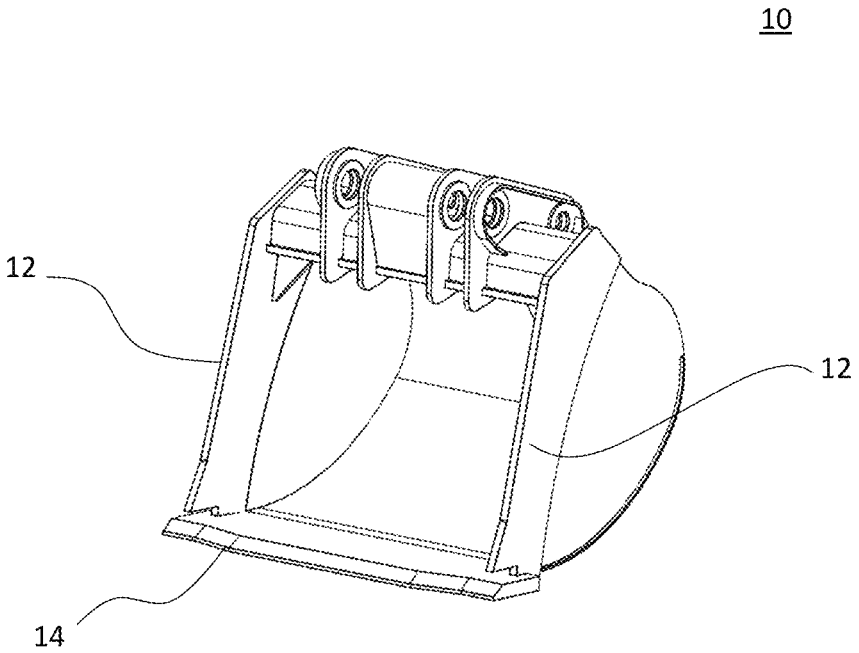
FIG. 1 shows an example of a bucket.
Figure 2:
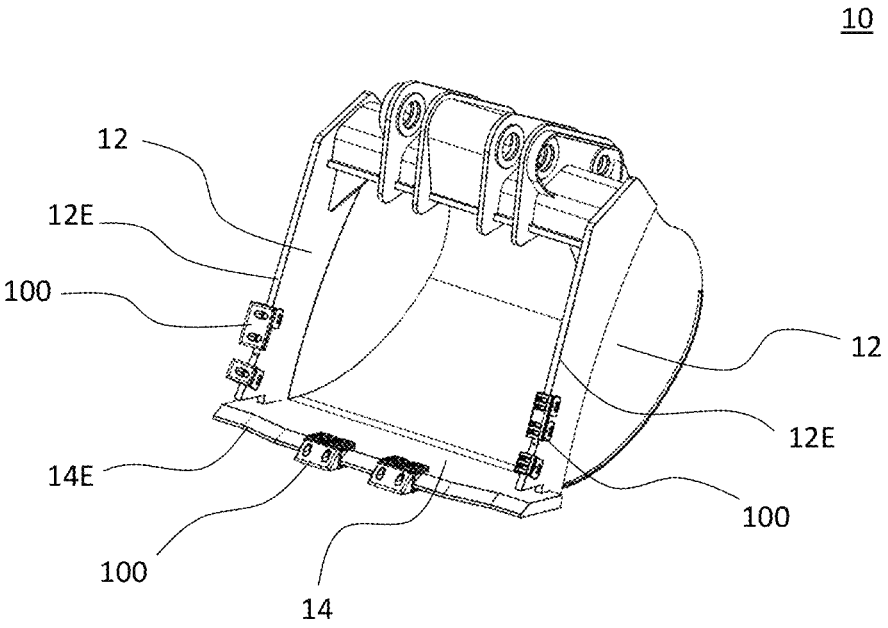
FIG. 2 shows a perspective view of an example of a bucket with a plurality of edge wear protector systems.

FIG. 2 shows a perspective view of an example of a bucket 10 with a plurality of edge wear protector systems 100. Bucket 10 may be formed by a plurality of plates joined together. As shown in FIG. 2, the bucket 10 may include side or cheek plates 12 and a base or lip plate 14 extending between the cheek plates 12. Each of the plurality of plates have an edge that engages the earth during operation, e.g. excavation. Each of the cheek plate may have a cheek edge 12E. Lip plate 14 may have a lip edge 14E. Cheek plate 12 and lip plate 14 may generally be known as plates 11. Cheek plate 12 and the lip plate 14 may be attached with a plurality of edge wear protector systems 100 to protect the respective edges from wear and tear.

Figure 3:
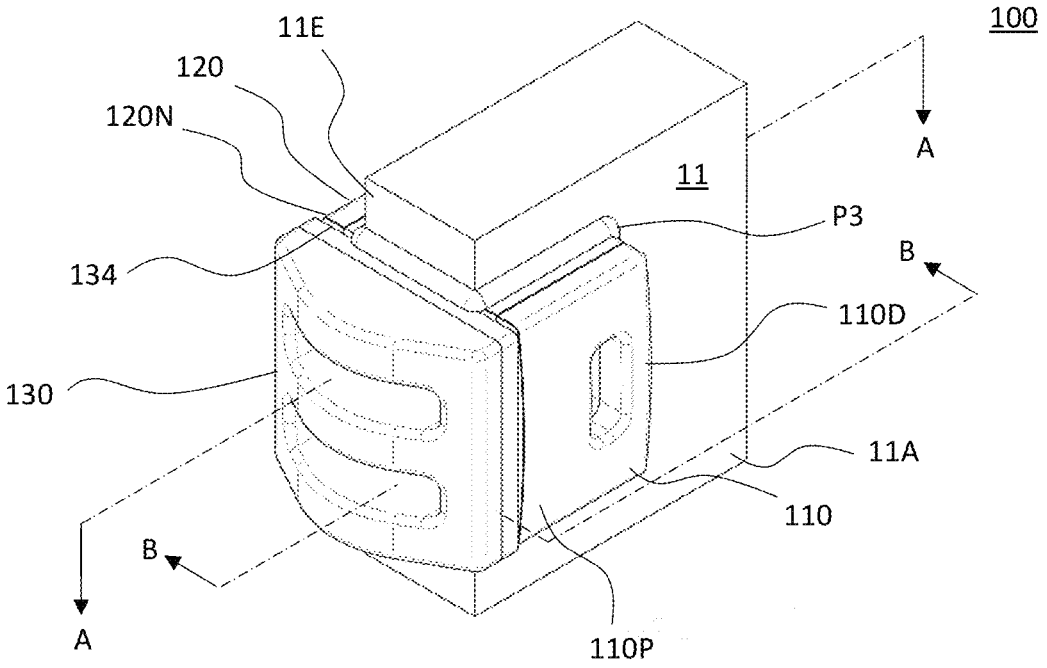
FIG. 3 shows a perspective view of an example of an edge wear protector system adapted to be attached to a plate of a bucket.

FIG. 3 shows a perspective view of an example of an edge wear protector system 100 adapted to be attached to a plate 11 of a bucket 10. Edge wear protector system 100 includes a first side member 110 comprising a proximal end 110P and a distal end 110D opposite the proximal end 110P. First side member 110 is adapted to be attached to one side 11A of the plate 11. Protector system 100 includes a second side member 120 having a near end 120N and a far end 120F (not shown in FIG. 3) opposite the near end 120N. Second side member 120 is adapted to be attached to another side 11B (not shown in FIG. 3) of the plate 11, the another side 11B of the plate 11 being opposite the one side 11A of the plate 11. Protector system 100 has an end member 130 adapted to be attached to an edge 11E of the plate 11, the edge 11E of the plate 11 extends from the one side 11A to the another side 11B of the plate 11, such that the first side member 110 is attachable to the end member 130 via its proximal end 110P and the second side member 120 is attachable to the end member 130 via the near end 120N. Plate 11 may be the cheek plate 12. Protector system 100 may be suitable to be installed onto the cheek plate 12 of the bucket 10. Protector system 100 may be welded onto the plate 11. Further details of the welding will be explained later.

The members, i.e. the first side member 110, the second side member 120 and the end member 130 may come in a variety of sizes and dimensions to cater to buckets with plates of various thickness. In this way, it is possible not to stock a large number of protector systems 100 to cater to more variety of buckets. Consequently, the inventory and storage space for the protector system 100 may be reduced. Further, by having separate members for each protector system 100, it is not necessary to change the whole protector system 100 as only the worn out member needs to be replaced. In this way, the maintenance costs may be reduced.

Figure 4:
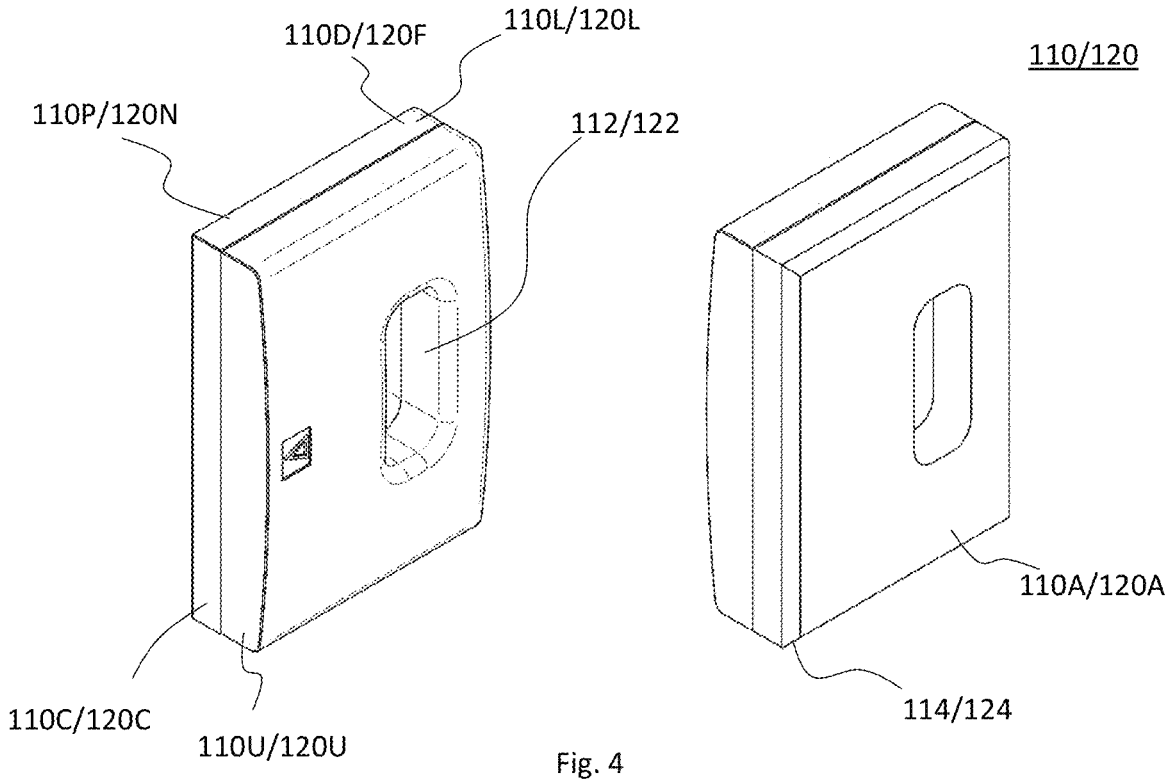
FIG. 4 shows a front and a rear perspective views of the first side member.

FIG. 4 shows a front and a rear perspective views of the first side member 110. First side member 110 may be identical to the second side member 120. Therefore, the following description for the first side member 110 is applicable to the second side member 120 and the references to the features of the first side member 110 and the second side member 120 are shown side by side. First side member 110 may include an attaching side 310A 110A adapted to contact the plate 11 when the first side member 110 is attached to the plate 11 (not shown in FIG. 4). Attaching side 310A 110A may include a plug duct 114 adapted to receive a plug weld (not shown in FIG. 4) therein. First side member 110 may include a connecting side adapted to contact the end member 130. Plug duct 114 may be disposed along an intersection between the attaching side 310A 110A and the connecting side 110C of the first side member 110. Plug duct 114 may extend beyond the intersection such that the plug duct 114 may be disposed along the perimeter of the attaching side 310A 110A. Plug duct 114 may be disposed along the perimeter of the connecting side 110C. Plug duct 114 may be a chamfer along an edge of the first side member 110. First side member 110 may include an access hole 112 extending through the first side member 110. Access hole 112 may be disposed on the attaching side 310A 110A. First side member 110 may include more than one access hole 112. First side member 110 may include an upper layer 110U and a lower layer 110L adapted to be connected to the plate 11, such that the upper layer 110U may be made from a material harder than that of the lower layer 110L. As the upper layer 130U is the outer layer of the first side member 110 when the protector system 100 is being installed onto the plate 11, the harder upper layer 130U is able to withstand more abrasion and enables the protector system 100 to last longer.

Figure 5:
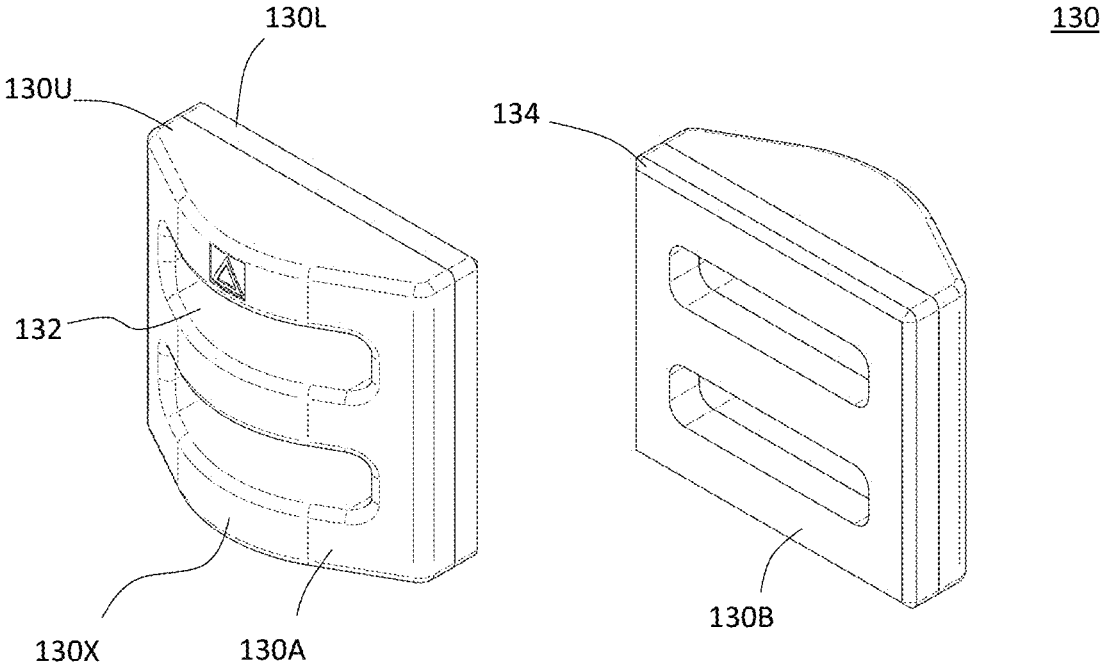
FIG. 5 shows a front and a rear perspective views of the end member.

FIG. 5 shows a front and a rear perspective views of the end member 130. End member 130 may include a front side 130A and a rear side 130B behind the front side 130A. As shown in FIG. 5, the end member 130 may have a protruding front side 130A. Front side 130A may have a triangular sectional profile such that the centre portion of the end member 130 extends further than the side portions from the rear side 130B. Having a triangular sectional profile, the front side 130A may have an apex 130X that is about centre to the end member 130. Alternatively, the apex 130X may not be at the centre and may be closer to a side of the end member 130. As the front side 130A, when in operation, is being driven into the earth, the protruding profile improves the penetration of the plate 11 (not shown in FIG. 5) into the earth. End member 130 may include an access hole 132 extending through the end member 130 such that the access hole 132 may extend from the front side 130A to the rear side 130B. Access hole 132 may be adapted to be connected to at least one of the first side member 110 and the second side member 120 (not shown in FIG. 5) when the end member 130 is installed onto the plate 11. End member 130 may be attached to the plate 11 via the rear side 130B. End member 130 may include an upper layer 130U and a lower layer 130L adapted to be connected to the plate 11, such that the upper layer 130U may be made from a material harder than that of the lower layer 130L. As shown in FIG. 5, the front side 130A may reside on the upper layer 130U and the rear side 130B may reside on the lower layer 130L. As the upper layer 130U is the outer layer of the end member 130 when the protector system 100 is being installed onto the plate 11, the harder upper layer is able to withstand more abrasion and enables the protector system 100 to last longer. End member 130 may include a plug duct 134 extending along the perimeter of the rear side 130B. Plug duct 134 may be adapted to receive a plug weld (not shown in FIG. 5) therein when the end member 130 is being welded onto the plate 11. Although reference is made to an access hole 132, the end member 130 may include more than one access hole as shown in FIG. 5.

Figure 6:
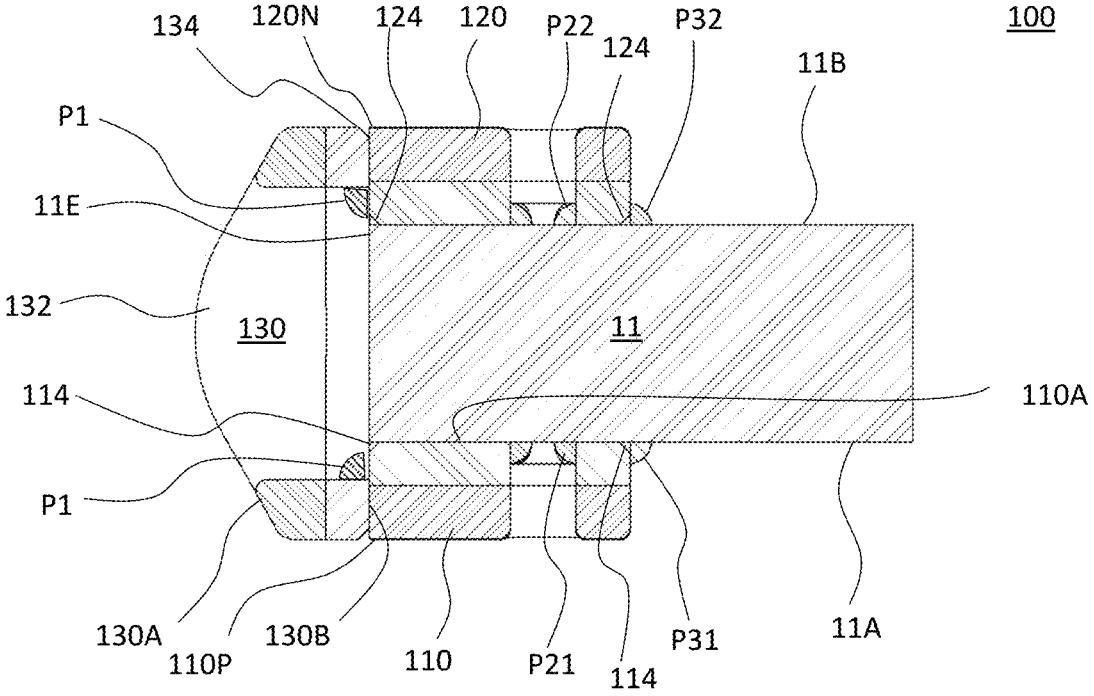
FIG. 6 shows a sectional view of the edge wear protector system as shown in FIG. 3 along line A-A.

FIG. 6 shows a sectional view of the edge wear protector system 100 as shown in FIG. 3 along line A-A. Protector system 11 has been mounted to the plate 11. As shown in FIG. 5, the first side member 110 may be attached to one side 11A of the plate 11 and the second side member 120 may be attached to the another side 11B of the plate 11. End member 130 may be attached to the edge 11E of the plate 11 and onto the first side member 110 and the second side member 120. First side member 110 may be attachable to the rear side 130B of the end member 130 via its proximal end 110P and the second side member 120 is attachable to the rear side 130B of the end member 130 via the near end 120N.

As shown in FIG. 6, the access hole 132 of the end member 130 may be connected to the first side member 110 and the second side member 120 when the end member 130 is installed onto the plate 11. When viewing through the access hole 132, the connecting side 110C of the first side member 110 and the connecting side 120C of the second side member 120 may be seen. Edge 11E of the plate 11 may also be seen through the access hole 132. Plug weld P31 may be welded along the perimeter of the attaching side 310A 110A of the first side member 110 and onto the plate 11 to bond the first side member 110 to the plate 11. Plug weld P31 may be welded along the plug duct 114 of the first side member 110. Referring to the first side member 110, the access hole 112 on the first side member 110 may also provide access for a plug weld P21 to be welded between the first side member 110 and the plate 11. Plug weld P21 may be welded along the inner wall of the access hole 112 in contact with the plate 11 and onto the plate 11 to bond the first side member 110 to the plate 11. Similarly, for the second side member 120, a plug weld P32 may be welded along the plug duct 124 of the second side member 120. A plug weld P22 may be welded through the access hole 122 of the second side member 120 onto the second side member 120 and the plate 11. Plug weld P22 may be welded along the inner wall of the access hole 122 in contact with the plate 11 and onto the plate 11 to bond the second side member 120 to the plate 11. Upon welding the first side member 110 and the second side member 120 to the plate 11, the end member 130 may be installed onto the plate 11. Plug weld P1 may be welded on the inner wall of the access hole 132 that contacts the first side member 110 and the second side member 120 and on the plate 11, the first side member 110 and the second side member 120 through the access hole 132 so as to bond the end member 130 onto them. Plug duct 134 of the end member 130 may be welded to improve the bond between the end member 130 and the first side member 110 and the second side member 120. Instead of welding plug weld P31 and P32 onto connecting side 110C of the first side member 110 and the connecting side 120C of the second side member 120, the plug weld P1 may be welded into the plug duct 114 of the first side member 110 and plug duct 124 of the second side member 120 at the same when it is being welded onto the inner wall of the access hole 132. Alternatively, it is possible to weld only the plug welds P21 and P22 to secure the first side member 110 and the second side member 120 to the plate 11 first, and a single weld along the first side member 110, the second side member 120 and the end member 130. As shown in FIG. 3, a plug weld P3 may be welded into the plug duct 114 along perimeter of the attaching side 310A 110A of the first side member 110, a portion of the plug duct 134 of the end member 130, into the plug duct 124 along the perimeter of the attaching side 310A 120A of the second side member 120, another portion of the plug duct 134 opposite the abovementioned portion of the end member 130 and back to the plug duct of the plug duct 114 of the first side member 110 where the plug weld P3 started. In this way, a complete outer plug weld P3 is provided between the protector system 100 and the plate 11 along the perimeter of the respective attaching side 310As 110A,120A and the rear side 130B of the first side member 110, second side member 120 and the end member 130. By providing plug welds around and within the members, the bond between the members to the plate 11 will be enhanced to withstand more harsh conditions during operation.

Figure 7:
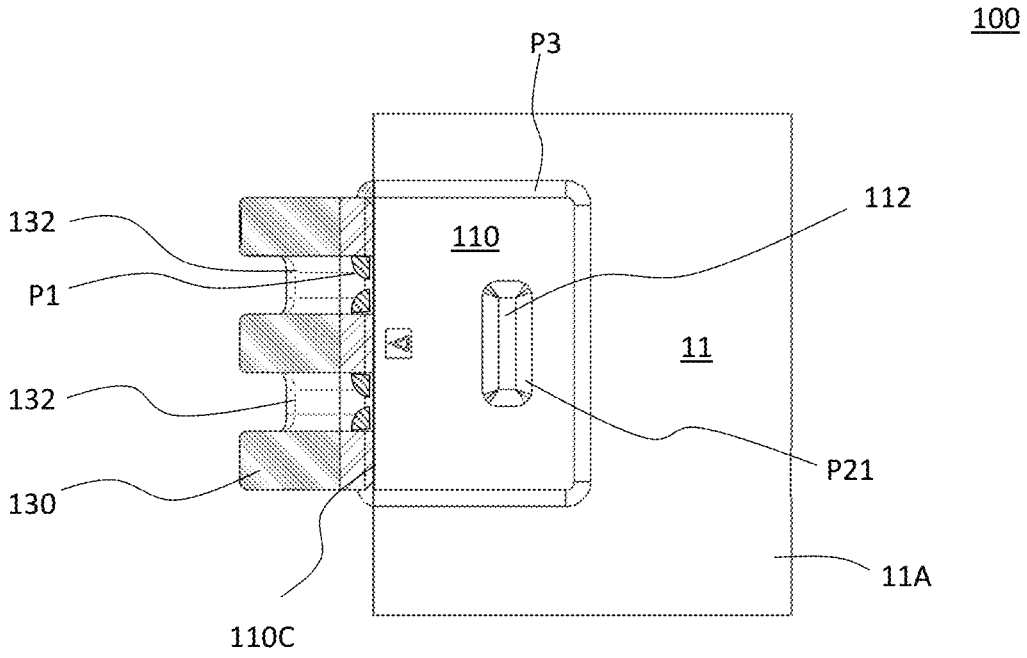
FIG. 7 shows a partial sectional view of the protector system as shown in FIG. 3 along line B-B.

FIG. 7 shows a partial sectional view of the protector system 100 as shown in FIG. 3 along line B-B. As shown, the first side member 110 may be attached to one side 11A of the plate 11 and connected to the end member 130 via its connecting side 110A. Second side member 120 is hidden behind the plate 11 and it is attached to the another side 11B (not shown in FIG. 7) of the plate 11 and attached to the end member 130 via its connecting side (not shown in FIG. 7). As shown, the plug weld P1 may be welded onto the end member 130, the first side member 110 and second side member 120 (not shown in FIG. 7) through the access hole 132 of the end member 130. Plug weld P21 may be welded onto the first side member 110 and the plate 11 through the access hole 112 of the first side member 110. Though not shown, the plug weld P22 may be welded onto the second side member 120 and the plate 11 through the access hole 122 of the second side member 110. As shown, the plug weld P3 may be welded along the perimeter of the first side member 110, the sides of the end member 130 and along the perimeter of the second side member 120 (not shown in FIG. 7) to provide a complete outer complete plug weld around the protector system 100 and the plate 11. Referring to FIG. 7, the first member 110 may have a marker 116 disposed at the proximal end 110P of the first member 110. Marker 116 may indicate the direction for installing the first member 110. Marker 116 may be included in the second member 120 as well.

Figure 8:
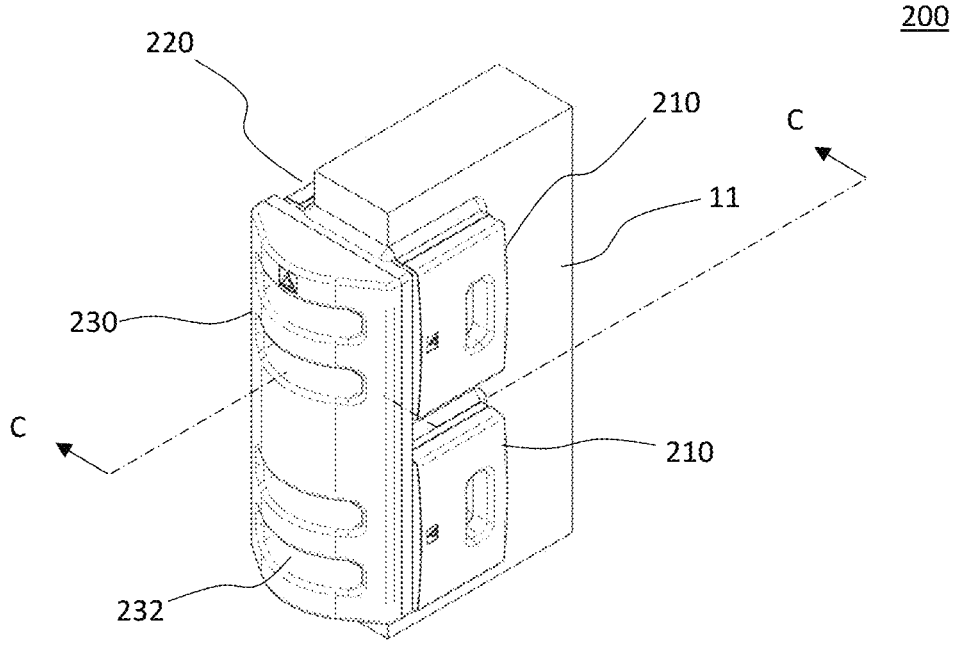
FIG. 8 shows a perspective view of an example of the protector system.

FIG. 8 shows a perspective view of an example of the protector system 200. Protector system 200 may have the end member 230 and more than one first side member 210 and more than one second side member 220 connected to the end member 230. As shown in FIG. 8, the protector system 200 may have two first side members 210, two second side members 220 (not shown in FIG. 8) and one end member 230 connected to the plate 11. First side member 210 and second side member 220 are identical to the ones shown in the earlier examples. End member 230 may be longer than the one shown in the earlier examples. As such, the features as mentioned for the first side member 210, the second side member 220 and the end member 230 in the earlier example are found in the present example in FIG. 8. Protector system 200 may be suitable for the cheek plate 12 of the bucket 10. Compared to the example in FIG. 3, the protector system 100 in FIG. 8 may be suitable for cheek plates 12 with straight planar profile. The example of the protector system 100 in example in FIG. 3 may be suitable for cheek plates 12 with curved or non-straight profile.

Figure 9:
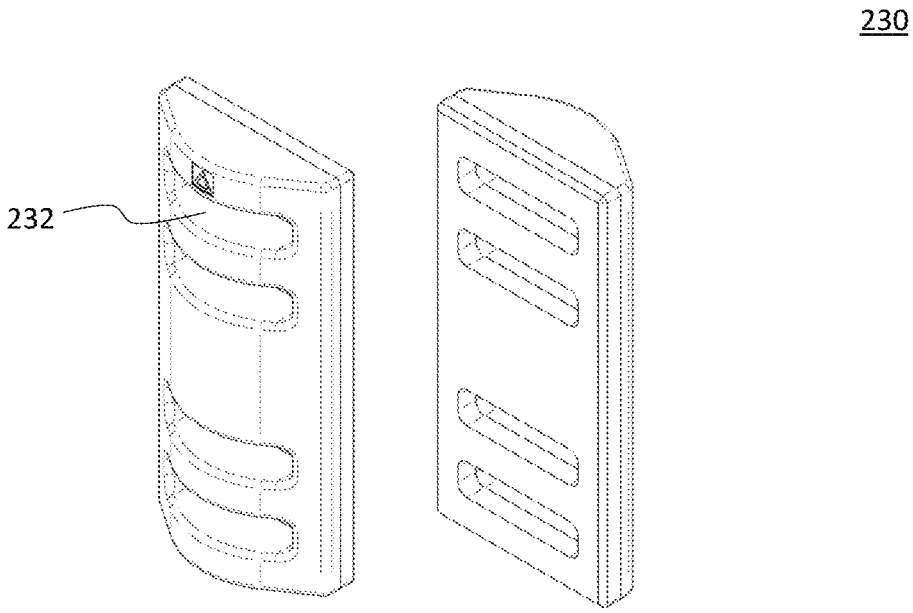
FIG. 9 shows a front and a rear perspective view of the end member as shown in FIG. 8.

FIG. 9 shows a front and a rear perspective view of the end member 230 as shown in FIG. 8. End member 230 may have a plurality of access holes 232 extending therethrough. As shown in FIG. 9, the end member 230 may have four access holes 232.

Figure 10:
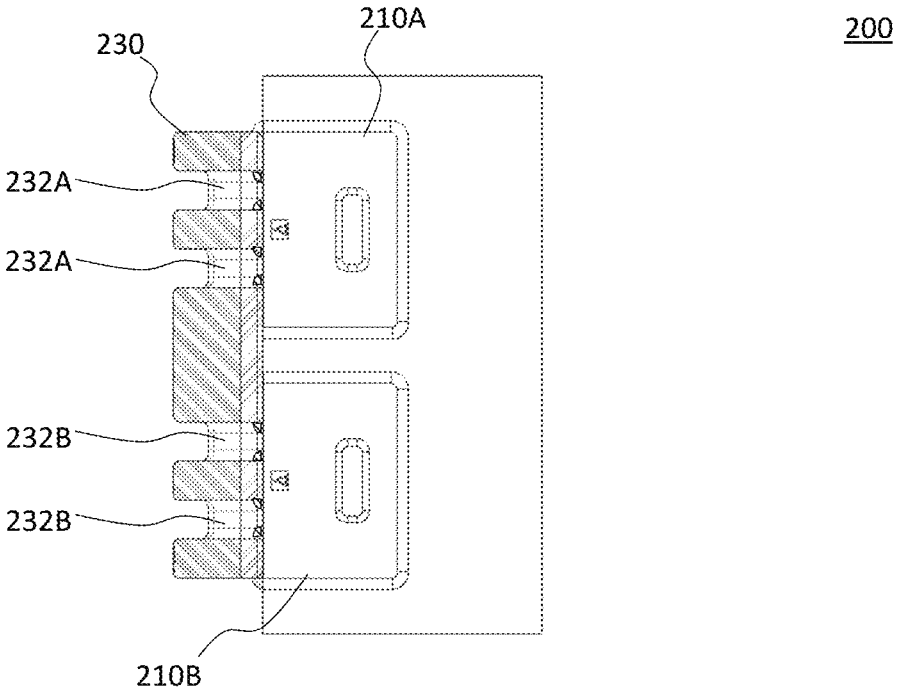
FIG. 10 shows a partial sectional view of example in FIG. 8.

FIG. 10 shows a partial sectional view of example in FIG. 8. As shown in FIG. 10, the plurality of access holes 232 of the end member 230 may be connected to the plurality of first side members 210 and the second side members 220. Referring to FIG. 10, the access holes 232A may be connected to the first side members 210A and the access holes 232B may be connected to the first side members 210B.

Figure 11:
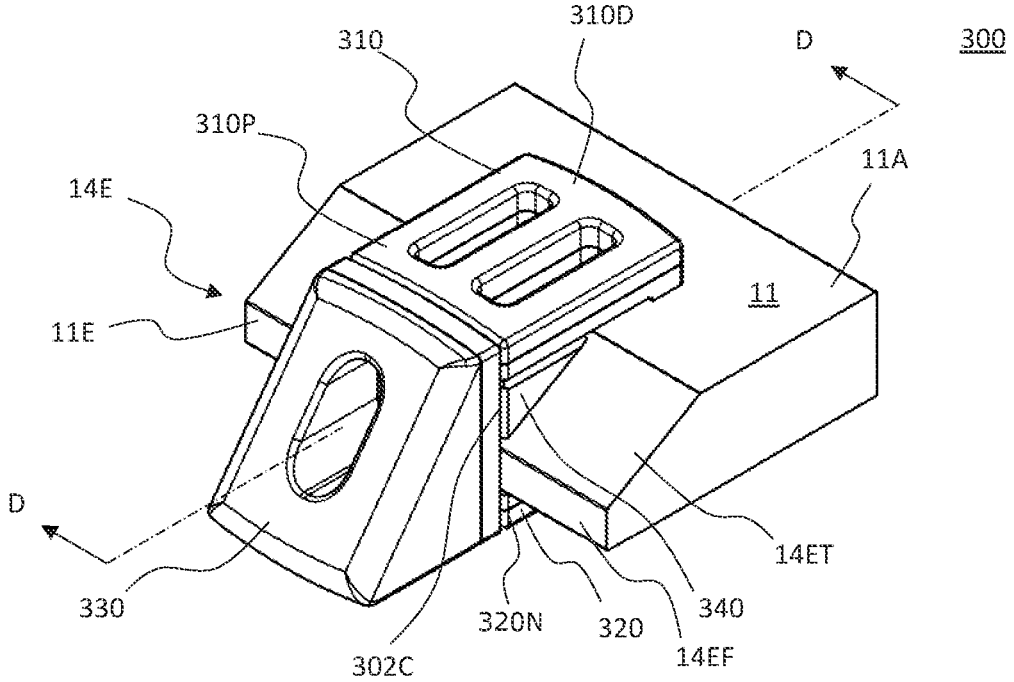
FIG. 11 shows a perspective view of an example of the edge wear protector system adapted to be attached to a plate of a bucket.

FIG. 11 shows a perspective view of an example of the edge wear protector system 300 adapted to be attached to a plate 11 of a bucket 10. Edge wear protector system 300 includes a first side member 310 comprising a proximal end 310P and a distal end 310D opposite the proximal end 310P. First side member 310 is adapted to be attached to one side 11A of the plate 11. Protector system 300 includes a second side member 320 having a near end 320N and a far end 320F (not shown in FIG. 11) opposite the near end 320N. Second side member 320 is adapted to be attached to another side 11B (not shown in FIG. 11) of the plate 11, the another side 11B of the plate 11 being opposite the one side 11A of the plate 11. Protector system 300 has an end member 330 adapted to be attached to an edge 11E of the plate 11, the edge 11E of the plate 11 extends from the one side 11A to the another side 11B of the plate 11, such that the first side member 310 is attachable to the end member 330 via its proximal end 310P and the second side member 320 is attachable to the end member 330 via the near end 320N. Protector system 300 may include a filler member 340 adapted to be attached to the plate 11, the filler member 340 adapted support at least one of the first side member 310 and the end member 330. Filler member 340 may be adapted to be connected to at least one of the first side member 310 and the end member 330. Protector system 300 may be suitable to be installed onto the lip plate 14 of the bucket 10.

Referring to FIG. 11, a lip edge 14E of the plate 11, i.e. a lip plate 14, is different from the cheek edge 12E of the cheek plate 12. Lip edge 14E has a flat portion 11EF perpendicular to the one side 11A and the another side 11B and a tapered portion 11ET extending from the flat portion 11EF to the one side 11A such that the tapered portion 11ET forms chamfer at one end of the plate 11. Cheek edge 12E as shown in FIG. 3 has a square profile. As shown in FIG. 11, the end member 330 may be attached to the flat portion 11EF of the lip edge 14E and the filler member 340 may be attached to the tapered portion 11ET of the plate 11.

Figure 12:
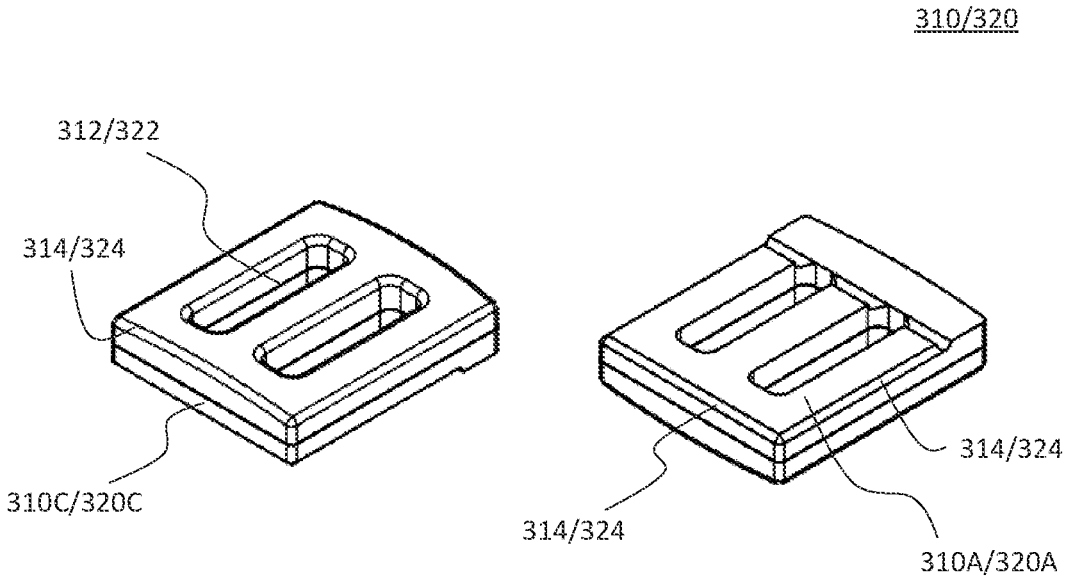
FIG. 12 shows a top and a bottom perspective views of the first side member.

FIG. 12 shows a top and a bottom perspective views of the first side member 310. First side member 310 may be identical to the second side member 320. Therefore, the following description for the first side member 310 is applicable to the second side member 320 and the references to the features of the first side member 310 and the second side member 320 are shown side by side. First side member 310 may include an attaching side 310A adapted to contact the plate 11 (not shown in FIG. 12) when the first side member 310 is attached to the plate 11. Attaching side 310A may include a plug duct 314 adapted to receive a plug weld (not shown in FIG. 12) therein. First side member 310 may include a connecting side 310C adapted to contact the end member 330. Plug duct 314 may be disposed along an intersection between the attaching side 310A and the connecting side 310C of the first side member 310. Plug duct 314 may extend beyond the intersection such that the plug duct 314 may be disposed along the perimeter or substantially part thereof the attaching side 310A. Plug duct 314 may extend around the perimeter of the connecting side 310C. Plug duct 314 may be a chamfer along an edge of the first side member 310. First side member 310 may include an access hole 312 extending through the first side member 310. Access hole 312 may be disposed on the attaching side 310A. Although reference is made to an access hole 312, the first side member 310 and the second side member 320 may include more than one access hole 312 as shown in FIG. 12. First side member 310 may include an upper layer 310U and a lower layer 310L adapted to be connected to the plate 11, such that the upper layer 310U may be made from a material harder than that of the lower layer 310L. As the upper layer 310U is the outer layer of the first side member 310 when the protector system 300 is being installed onto the plate 11, the harder upper layer 310U is able to withstand more abrasion and enables the protector system 300 to last longer.

Figure 13:
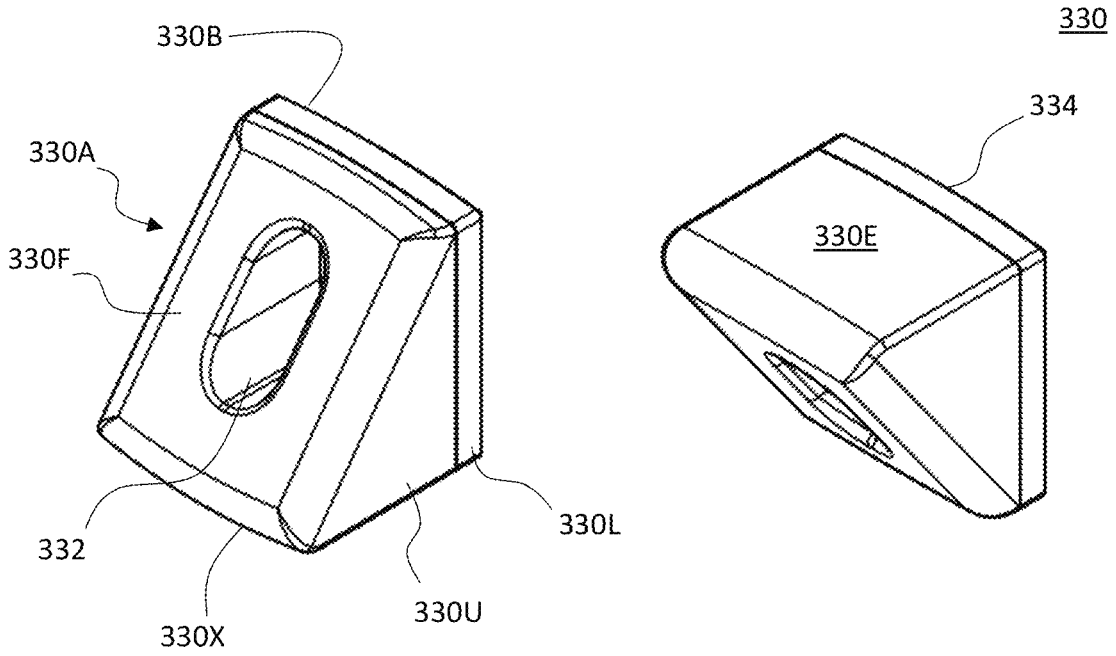
FIG. 13 shows a top and a bottom perspective views of the end member.

FIG. 13 shows a top and a bottom perspective views of the end member 330. End member 330 may include a front side 330A and a rear side 330B behind the front side 330A. As shown in FIG. 13, the end member 330 may have a protruding front side 330A. Front side 330A may include an outwardly protruding wedge. Wedge may be formed by a front face 330F and a base face 330E, both extending from the rear side 330B and meeting to form the apex 330X. Based face 330E may be perpendicular to the rear side 330B. As the front side 330A, when in operation, is being driven into the earth, the protruding wedge improves the penetration of the plate 11 (not shown in FIG. 13) into the earth. End member 330 may include a plug duct 314 along the perimeter of the rear side 330B. End member 330 may include an access hole 332 extending through the end member 330 such that the access hole 332 may extend from the front side 330A to the rear side 330B. End member 330 may be attached to the plate 11 via the rear side 330B. End member 330 may include an upper layer 330U and a lower layer 330L adapted to be connected to the plate 11, such that the upper layer 330U may be made from a material harder than that of the lower layer 330L. As shown in FIG. 13, the front side 330A may reside on the upper layer 330U and the rear side 330B may reside on the lower layer 330L. As the upper layer 330U is the outer layer of the end member 330 when the protector system 300 is being installed onto the plate 11, the harder upper layer is able to withstand more abrasion and enables the protector system 300 to last longer. The wedge profiled end member 330, when installed onto the lip plate 14, may allow for more fill, e.g. earth, to enter the bucket 10 when digging. This is due to the wedge profile which creates preferential flow of the fill into the bucket 10.

Figure 14:
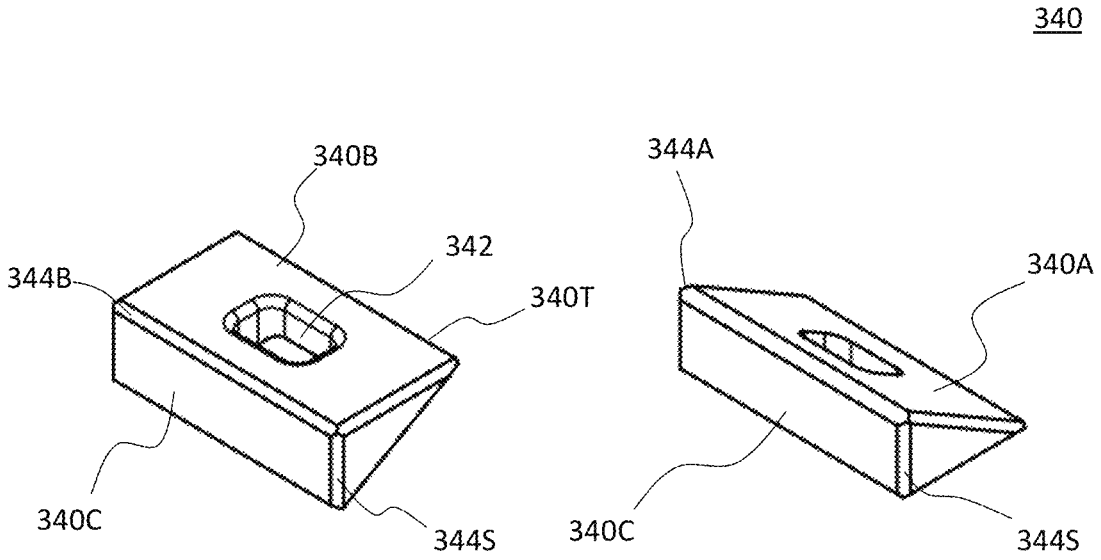
FIG. 14 shows a top and a bottom perspective view of the filler member as shown in FIG. 11.

FIG. 14 shows a top and a bottom perspective view of the filler member 340 as shown in FIG. 11. Filler member 340 may be adapted to be connected to at least one of the first side member 310 and the end member 330. Filler member 340 may include a first attaching surface 340A adapted to contact the plate 11 (not shown in FIG. 14) and a connecting surface 340C adapted to face the end member 330. Filler member 340 may include a first plug chamfer 344A disposed along an intersection between the first attaching surface 340A and the connecting surface 340C. First plug chamfer 344A may be adapted to receive a plug weld (not shown in FIG. 14). Filler member 340 may include a second attaching surface 340B adapted to face the first side member 310 (not shown in FIG. 14) and a connecting surface 340C adapted to face the end member 330 (not shown in FIG. 14). Filler member 340 may include a second plug chamfer 344B disposed along an intersection between the second attaching surface 340B and the connecting surface 340C. Second plug chamfer 344B may be adapted to receive a plug weld (not shown in FIG. 14). Filler member 340 may include a pair of side plug chamfers 344S connecting the first plug chamfer 344A and the second plug chamfer 344B. First attaching surface 340A and the second attaching surface 340B may form a tail edge 340T at their intersection. Filler member 340 may include a through hole 342. Through hole 342 may extend from the first attaching surface 340A to the second attaching surface 340B.

Figure 15:
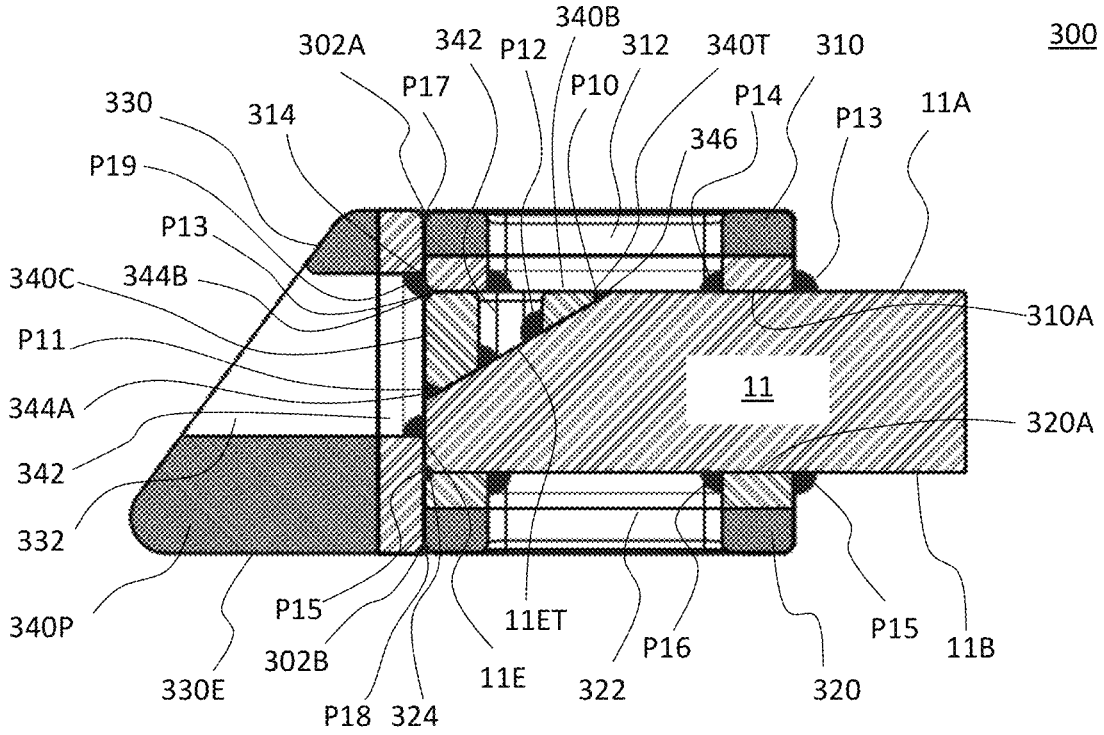
FIG. 15 shows a sectional view of the protector system in FIG. 11 along line D-D.

FIG. 15 shows a sectional view of the protector system 300 in FIG. 11 along line D-D. In FIG. 15, the protector system 300 has been installed onto the lip plate 14 of the bucket 10. The members 310,320,330,340 of the protector system 300 may be welded onto the lip plate 14. As shown in FIG. 15, the filler member 340 may be attached to the tapered portion 11ET of the edge 11E of the plate 11. A duct channel 346 may be formed between the tail edge 340T and the tapered portion 11ET of the plate 11 as the tail edge 340T of the filler member 340 may not connect to the one side 11A of the plate 11. A plug weld P10 may be welded along duct channel 346 to bond the tail edge 340T of the filler member 340 to the plate 11. A plug weld P11 may be welded between the first plug chamfer 344A of the filler member 340 and the tapered portion 11ET to bond the filler member 340 to the tapered portion 11ET of the plate 11. Plug welds (not shown in FIG. 15) may be welded along the perimeter of the first attaching surface 340A to connect plug welds P10 and P11 to form a complete outer perimeter weld around the filler member 340 onto the tapered portion 11ET. Plug weld P12 may be welded along the inner wall of the through hole 342 that contacts the tapered portion 11ET of the plate 11 and onto the tapered portion 11ET. Plug weld P12 may be welded via the through hole 342. In this way, the filler member 340 may be strongly bonded to the plate 11.

Thereafter, the first side member 310 may be attached onto the filler member 340 and the plate 11. First side member 310 may be attached to the plate 11 on the one side 11A of the plate 11. As shown in FIG. 15, the second attaching surface 340B may flush with the one side 11A of the plate 11 to provide a flat surface for the first side member 310 to be installed onto. A plug weld P13 may be welded within the plug duct 314 of the first side member 310 and the second plug chamfer 344B of the filler member 340 to enable the first side member 310 to be strongly bonded to the filler member 340. Plug weld P13 may extend around the first side member 310 along the outer perimeter of the attaching side 310A of the first side member 310. Plug weld P13 may be welded into the plug duct 314 around the perimeter of the attaching side 310A of the first side member 310. Access hole 312 of the first side member 310 may be connected to the one side 11A of the plate 11. A plug weld P14 may be welded along the inner wall of the access hole 312 that is in contact with the plate 11 and the filler member 340. Plug weld P14 may be welded onto the filler member 340 and the one side 11A of the plate 11. In this way, the first side member 310 may be strongly bonded to the filler member 340 and the plate 11.

Second side member 320 may be attached to the plate 11 on the another side 11B of the plate 11, which is opposite the one side 11A. A plug weld P15 may be welded into the plug duct 324 of the second side member 320. Plug weld P15 may extend around the second side member 320 along the outer perimeter of the attaching side 320A of the second side member 320. Plug weld P15 may be welded into the plug duct 324 around the perimeter of the attaching side 320A of the second side member 320. Access hole 322 of the second side member 320 may be connected to the another side 11B of the plate 11. A plug weld P16 may be welded along the inner wall of the access hole 322 that is in contact with the plate 11. Plug weld P15 may be welded onto the another side 11B of the plate 11. In this way, the second side member 320 may be strongly bonded to the plate 11.

End member 330 may be attached to the plate 11 on the edge 11E. Connecting surface 340C of the filler member 340 may flush with the flat portion 11EF of the edge 11E to form a flat surface for the end member 330 to be installed onto. End member 330 may be attached to the flat portion 11EF of the edge 11E and the connecting surface 340C of the filler member 340. A plug weld P17 may be welded along a plug channel 302A formed by the plug duct 314 along the perimeter of the connecting side 310C of the first side member 310 and the plug duct 334 along the perimeter of the rear side 330B of the end member 330 to bond the first side member 310 to the end member 330. A plug weld P18 may be welded along a plug channel 302B formed by the plug duct 334 along the perimeter of the rear side 330B of the end member 330 and the plug duct 324 along the perimeter of the connecting side 320C of the second side member 320 to bond the second side member 320 to the end member 330. A plug weld may be welded along a plug channel 302C (shown in FIG. 11) formed by the plug duct 334 along the perimeter of the rear side 330B of the end member 330 and the side plug chamfers 344S of the filler member 340 and the flat portion 11EF of the edge 11E to connect between the plug welds P17 and P18 along the side plug chamfers 334S of the filler member 340 to join the end member 330 to the filler member 340 and the edge 11E of the plate 11. Access hole 332 of the end member 330 may be adapted to be connected to at least one of the first side member 310, the second side member 320 and the filler member 340. Referring to FIG. 15, the access hole 332 may be adapted to connect to the first side member 310 and the filler member 340. Conceivably, the access hole 332 may be adapted to connect to the first side member 310, filler member, and the second side member 320 if the bottom portion 340P is thinner. A plug weld P19 may be welded onto the inner wall of the access hole 332 that is in contact with the first side member 310 and the filler member 340 and onto the first side member 310 and the filler member 340 to bond them together. Base face 330E of the end member 330 may be in line with the second side member 320 to form a flat surface. Front face 330F of the end member 330 may replace the tapered portion 11ET of the edge 11E to engage the earth during an operation.

Figure 16:
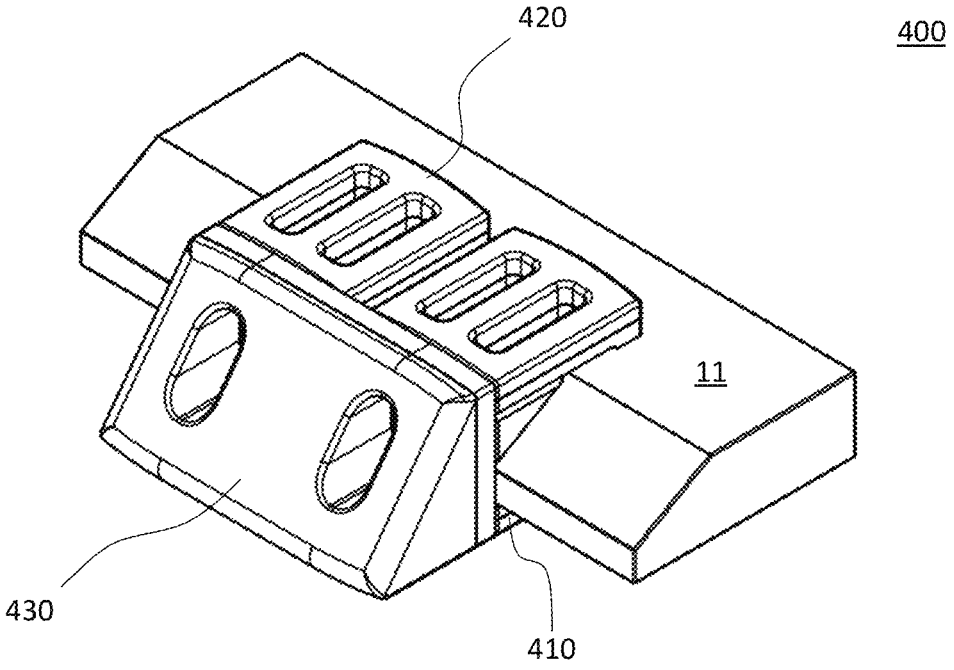
FIG. 16 shows a perspective view of an example of the edge wear protector system 400.

FIG. 16 shows a perspective view of an example of the edge wear protector system 400. Protector system 400 may have the end member 430 and more than one first side member 410 and more than one second side member 420 connected to the end member 430. As shown in FIG. 16, the protector system 400 may have two first side members 410, two second side members 420 and one end member 430 connected to the plate 11. First side member 410 and second side member 420 are identical to the ones shown in the earlier examples. End member 430 may be longer than the one shown in the earlier examples. As such, the features as mentioned for the first side member 410, the second side member 420 and the end member 430 in the earlier example are found in the present example in FIG. 16. Protector system 400 may be suitable for the lip plate 12 of the bucket 10. Compared to the example in FIG. 11, the protector system 100 in FIG. 16 may be suitable for lip plates 14 with straight planar profile. The example of the protector system 300 in example in FIG. 11 may be suitable for lip plates 14 with curved or non-straight profile.

Plug ducts and chamfers protect the plug weld from damage. Plug duct may be applicable to all the edges of all the attaching surfaces of the members to protect the plug welds. Besides providing more areas to weld the members onto the plate to create a stronger bond, the access holes and through holes reduce the weight of the members which reduces the weight of the protected bucket 10 during its operation. Indirectly, there will be savings in terms of less fuel consumption when operating a lighter bucket compared to conventional heavy buckets. A lighter bucket may also reduce fatigue on the associated structural components connected to the bucket.

Each member of the protector system may be made of two layers, a harder outer wear layer and a softer base inner layer. The outer wear layer may be made from cast steel alloy and the inner layer may be made from mild steel alloy. Cast steel alloy may have a hardness of about 700 HBW. Ceramics and other metallic and non-metallic materials may be used as inserts in the cast steel alloy outer layer. In this way, the life of the members may be increased, and the weight also may be minimised as compared to having the whole member being made from the same cast steel alloy material. The longer lasting harder outer layer of material also allows the edge wear protector system to have a lower profile than a conventional wear protector so that the protector system of the present invention reduces friction and drag on the bucket during a digging operation. By having a softer material on the base layer, higher quality welding can be achieved between the edge wear protector system and the bucket.

A skilled person would appreciate that the features described in one example may not be restricted to that example and may be combined with any one of the other examples.

The present invention relates to an edge wear protector system generally as herein described, with reference to and/or illustrated in the accompanying drawings.

The invention claimed is:

1. An edge wear protector system configured to be attached to a plate of a bucket, the edge wear protector system comprising:

a first side member comprising a proximal end and a distal end opposite the proximal end, the first side member configured to be attached to one side of the plate;

a second side member comprising a near end and a far end opposite the near end, the second side member configured to be attached to another side of the plate, the another side of the plate being opposite the one side of the plate;

an end member configured to be attached to an edge of the plate, the edge of the plate extends from the one side to the another side of the plate, the end member comprising a front side and a rear side behind the front side, wherein the rear side is a flat surface, wherein the end member is attached to the edge of the plate via the rear side, wherein the first side member is attachable to the rear side of the end member via its proximal end and the second side member is attachable to the rear side of the end member via the near end, wherein the end member comprises an access hole extending through the end member from the front side to the rear side, wherein the access hole is configured to be connected to at least one of the first side member, the second side member and the edge of the plate;

wherein the first side member is attachable to the rear side of the end member via its proximal end and the second side member is attachable to the rear side of the end member via the near end, wherein a plug weld is weldable on an inner wall of the access hole and onto at least one of the first side member, the second side member, and the edge of the plate.

2. The edge wear protector system of claim 1, wherein the end member comprises a protruding front side.

3. The edge wear protector system of claim 1, wherein the front side comprises an outwardly protruding wedge.

4. The edge wear protector system of claim 1, wherein the end member comprises an upper layer and a lower layer configured to be connected to the plate, wherein the upper layer is made from a material harder than that of the lower layer.

5. The edge wear protector system of claim 1, wherein the first side member comprises an access hole extending through the first side member.

6. The edge wear protector system of claim 1, wherein the first side member comprises an attaching side configured to contact the plate when the first side member is attached to the plate, the attaching side comprises a plug duct formed along an edge of the first side member, the plug duct being configured to receive at least a portion of a plug weld therein.

7. The edge wear protector system of claim 6, wherein the first side member comprises a connecting side configured to contact the end member, wherein the plug duct is disposed along an intersection between the attaching side and the connecting side of the first side member.

8. The edge wear protector system of claim 7, wherein the access hole of the end member is in communication with the plug duct of the first side member.

9. The edge wear protector system of claim 1, wherein the first side member comprises an outer layer and an inner layer configured to be connected to the plate, wherein the outer layer is made from a material harder than that of the inner layer.

10. The edge wear protector system of claim 1, wherein second side member comprises an access hole extending through the second side member.

11. The edge wear protector system of claim 1, wherein the second side member comprises an attaching side configured to contact the plate when the second side member is attached to the plate, the attaching side comprises a plug duct formed along an edge of the second side member, the plug duct being configured to receive at least a portion of a plug weld therein.

12. The edge wear protector system of claim 11, wherein the second side member comprises a connecting side configured to contact the end member, wherein the plug duct is disposed along an intersection between the attaching side and the connecting side of the second side member.

13. The edge wear protector system of claim 12, wherein the access hole of the end member is in communication with the plug duct of the second side member.

14. The edge wear protector system of claim 1, wherein the second side member comprises an outer layer and an inner layer configured to be connected to the plate, wherein the outer layer is made from a material harder than that of the inner layer.

15. The edge wear protector system of claim 1, further comprising a filler member configured to be attached to the plate, the filler member configured to support at least one of the first side member and the end member.

16. The edge wear protector system of claim 15, wherein the filler member is configured to be connected to at least one of the first side member and the end member.

17. The edge wear protector system of claim 15, wherein the filler member comprises a through hole.

18. The edge wear protector system of claim 15, wherein the filler member comprises a first attaching surface configured to contact the plate and a connecting surface configured to face the end member, wherein the filler member comprises a first plug chamfer disposed along an intersection between the first attaching surface and the connecting surface, the first plug chamfer configured to receive a plug weld.

19. The edge wear protector system of claim 15, wherein the filler member comprises a second attaching surface configured to face the first side member and a connecting surface configured to face the end member, wherein the filler member comprises a second plug chamfer disposed along an intersection between the second attaching surface and the connecting surface, the second plug chamfer configured to receive a plug weld.

20. The edge wear protector system of claim 15, wherein the end member comprises an access hole extending through the end member, wherein the access hole is configured to be in communication with at least one of the first side member, the second plate and the filler member.

* * * * *